US009957686B2

(12) United States Patent
Zarraonandia

(10) Patent No.: US 9,957,686 B2
(45) Date of Patent: May 1, 2018

(54) MODULAR FOUNDATION SYSTEM AND METHOD

(75) Inventor: David Zarraonandia, Thousand Oaks, CA (US)

(73) Assignee: PRE-CON PRODUCTS, LTD., Simi Valley, CA (US)

( * ) Notice: Subject to any disclaimer, the term of this patent is extended or adjusted under 35 U.S.C. 154(b) by 0 days. days.

(21) Appl. No.: 12/884,047

(22) Filed: Sep. 16, 2010

(65) Prior Publication Data

US 2011/0219713 A1 Sep. 15, 2011

Related U.S. Application Data

(60) Provisional application No. 61/243,026, filed on Sep. 16, 2009.

(51) Int. Cl.

| | |
|---|---|
| ***E02D 27/01*** | (2006.01) |
| ***E02D 27/32*** | (2006.01) |
| ***E02D 29/02*** | (2006.01) |
| ***E04C 1/39*** | (2006.01) |

(52) U.S. Cl.

CPC ..... *E02D 27/01* (2013.01); *E02D 27/32* (2013.01); *E02D 29/025* (2013.01); *E04C 1/39* (2013.01); *E02D 27/016* (2013.01)

(58) Field of Classification Search

CPC ..... E02D 27/32; E02D 29/025; E04C 2/38; E04C 1/395; E04B 1/38; E01C 5/00

USPC .. 52/223.1, 223.6, 223.7, 223.9, 292, 740.1, 52/608, 609, 293.2, 591.1

See application file for complete search history.

(56) References Cited

U.S. PATENT DOCUMENTS

| | | | | |
|---|---|---|---|---|
| 1,870,539 A * | 8/1932 | Warner et al. | ..... | 405/152 |
| 2,057,738 A * | 10/1936 | Pipes | ..... | 404/33 |
| 2,565,369 A * | 8/1951 | Hamilton | ..... | 114/266 |
| 3,148,482 A * | 9/1964 | Neale | ..... | 52/390 |
| 3,302,345 A * | 2/1967 | Ballantine | ..... | 52/121 |
| 3,665,882 A * | 5/1972 | Georgiev et al. | ..... | 114/266 |

(Continued)

FOREIGN PATENT DOCUMENTS

KR 200366906 11/2004

OTHER PUBLICATIONS

International Preliminary Report on Patentability, from corresponding PCT Appl. No. PCT/US2010/002544, dated Mar. 29, 2012.

(Continued)

*Primary Examiner* — Paola Agudelo

(74) *Attorney, Agent, or Firm* — Koppel, Patrick, Heybl & Philpott

(57) ABSTRACT

The present invention is directed to a customizable, modular foundation system using blocks and post-tensioning for improved structural integrity of the foundation. In some embodiments, the improved foundation system is provided by post-tensioning a plurality of blocks together such that cables or bars used for tensioning run in different directions than any of the joint lines between adjacent blocks. In this way, there are no bendable joints between adjacent blocks. Moreover, in some embodiments the blocks are hexagonal, such that each block has six sides and post-tensioning cables can run in at least three different directions. Structures or apparatuses may be secured to the foundation comprised of multiple blocks, with the foundation being rigid, customizable, and both assembled and usable in any desired location.

11 Claims, 5 Drawing Sheets

(56) References Cited

U.S. PATENT DOCUMENTS

| | | | | |
|---|---|---|---|---|
| 3,951,085 | A * | 4/1976 | Johnson et al. | 114/266 |
| 4,095,388 | A * | 6/1978 | Breault | 52/747.11 |
| 4,152,875 | A * | 5/1979 | Soland | 52/223.7 |
| 4,357,786 | A * | 11/1982 | Finzi | 52/651.02 |
| 4,372,705 | A | 2/1983 | Atkinson | |
| 4,503,645 | A * | 3/1985 | Nudd et al. | 52/40 |
| 4,546,583 | A * | 10/1985 | Hussar | 52/236.1 |
| 4,669,917 | A * | 6/1987 | Sveen | 405/227 |
| 4,875,803 | A * | 10/1989 | Scales | 405/16 |
| 4,951,433 | A * | 8/1990 | Miller et al. | 52/126.6 |
| 5,020,938 | A * | 6/1991 | Scales | 405/16 |
| 5,832,688 | A * | 11/1998 | Crissey et al. | 52/651.01 |
| 5,937,602 | A * | 8/1999 | Jalbert | 52/318 |
| 6,037,031 | A * | 3/2000 | Jones et al. | 428/71 |
| 6,050,038 | A * | 4/2000 | Fey et al. | 52/223.7 |
| 6,231,272 | B1 * | 5/2001 | Bishop | 405/286 |
| 6,702,522 | B2 * | 3/2004 | Silber | 405/229 |
| 6,739,797 | B1 * | 5/2004 | Schneider | 404/35 |
| 7,870,691 | B2 * | 1/2011 | Williams et al. | 47/65.9 |
| 8,234,834 | B2 * | 8/2012 | Martensson et al. | 52/747.1 |
| 2002/0023394 | A1 * | 2/2002 | McGinnis | 52/79.1 |
| 2004/0221529 | A1 * | 11/2004 | Zornes | 52/311.1 |
| 2005/0097860 | A1 * | 5/2005 | Martensson | 52/782.1 |
| 2006/0130415 | A1 * | 6/2006 | Weber | 52/292 |
| 2006/0272262 | A1 * | 12/2006 | Pomberger | 52/589.1 |
| 2007/0095008 | A1 * | 5/2007 | Arsene | 52/745.04 |
| 2008/0072511 | A1 * | 3/2008 | Phuly | 52/294 |
| 2009/0031639 | A1 * | 2/2009 | Cortina/Cordero | 52/40 |
| 2009/0249707 | A1 * | 10/2009 | Curme | 52/40 |
| 2010/0083604 | A1 * | 4/2010 | Vangsy et al. | 52/651.01 |
| 2010/0132270 | A1 * | 6/2010 | Willey et al. | 52/79.5 |
| 2011/0283640 | A1 * | 11/2011 | Miller | 52/292 |
| 2011/0299937 | A1 * | 12/2011 | Cortina-Ortega et al. | 405/224 |
| 2013/0067853 | A1 * | 3/2013 | Baker | 52/745.17 |
| 2013/0233231 | A1 * | 9/2013 | Dagher et al. | 114/265 |

OTHER PUBLICATIONS

Written Opinion from corresponding PCT App. No. PCT/US2010/002544, dated Jun. 3, 2011.

* cited by examiner

FIG. 1
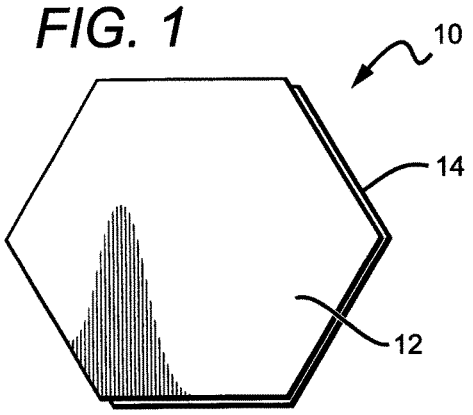
FIG. 2
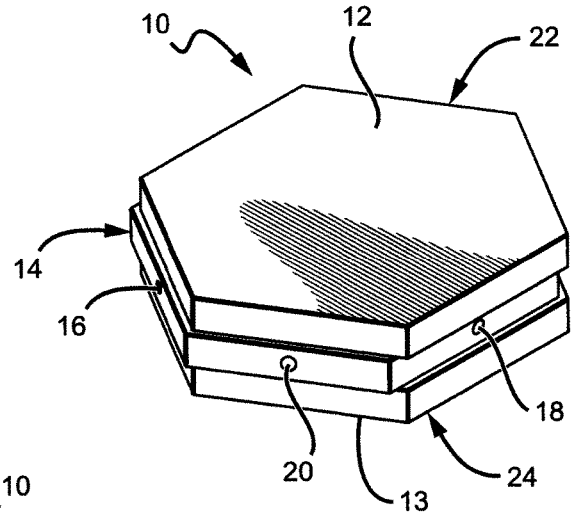
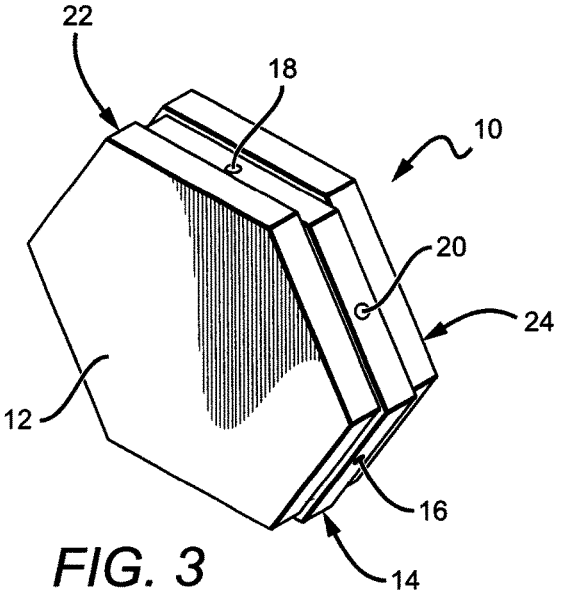
FIG. 3
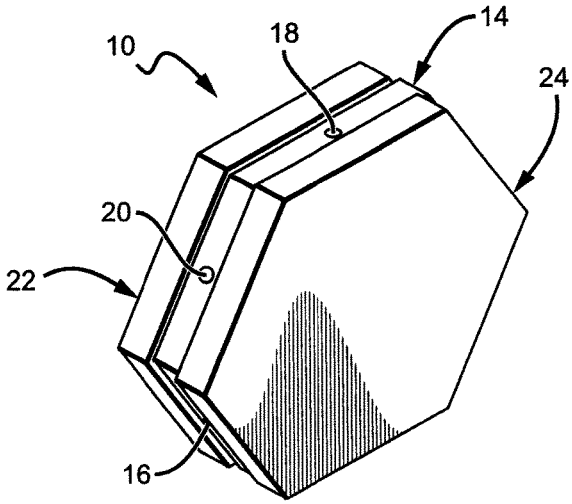
FIG. 4

MODULAR FOUNDATION SYSTEM AND METHOD

This application claims the benefit of U.S. Provisional Application No. 61/243,026 to Zarraonandia, which was filed on 16 Sep. 2009.

BACKGROUND OF THE INVENTION

Field of the Invention

This invention relates to foundation systems and more particularly to modular foundation systems for supporting structures such as towers, shelters, antennas, and the like as well as apparatuses such as generators, fuel tanks, and the like.

Description of the Related Art

Structures such as towers, antennas, and shelters and apparatuses such as generators and fuel tanks often require foundations to ensure proper support and stability. Numerous foundation systems have been developed over the years to attempt to stabilize such structures and apparatuses. However, many of these structures and apparatuses are often needed in remote locations where access can be difficult and/or in locations where installation of a traditional, onsite poured foundation is not cost-effective or practical. It is thus desirable to provide a foundation system that is customizable and can be easily transported to any location and assembled onsite.

In U.S. Pat. No. 6,050,038 to Fey el al., a foundation system for supporting superstructures that is readily transported to remote locations and assembled onsite is disclosed. The foundation system is comprised of a plurality of rectangular/square blocks that can be arranged in a number of configurations and then secured to one another using post-tensioning. However, due to the shape of each block and the orientation of the post-tensioning mechanisms, there are multiple hinge points along the foundation system. The lines of the post-tensioning mechanism run in two different directions, both parallel and perpendicular to the various joints between the foundation blocks. The lines running perpendicular to any given hinge points are the only mechanisms preventing the blocks from bending. This results in a foundation that can readily bend at various hinge points should the post-tensioning mechanism fail, which can weaken the overall foundation.

Moreover, various existing foundation systems comprise overall shapes that may not match the base shape of the structure and/or apparatus the system is supposed to stabilize. This can be inefficient or less efficient than providing a foundation system with an overall shape that generally matches the base shape of what is to be stabilized. Additionally, it can be problematic as the bolts and bolt holes used to anchor the structure or apparatus to the foundation system may not take site variations into account and thus may not be perfectly aligned during onsite assembly. It is desirable to provide a foundation system that not only substantially matches the overall shape of the base of the structure or apparatus it is used to stabilize, but also provides a customizable means to anchor the structure or apparatus to the foundation system with onsite adjustment. It is also desirable to provide a foundation system with modular components that are durable for shipping and handling and limited to weights appropriate for transfer to remote locations.

SUMMARY OF THE INVENTION

The present invention seeks to provide modular foundation systems and methods for securing and stabilizing structures and apparatuses with an improved and customizable approach that is durable, cost-effective, and incomplex.

One embodiment comprises a modular foundation system with a plurality of blocks, a plurality of holes through each of said blocks, and a plurality of cables or bars running through said holes. Each of the blocks is configured next to at least one other of the blocks such that the holes of adjacent blocks are aligned. The cables or bars fix the blocks together. The cables run in different directions than the joint lines between adjacent blocks.

Another embodiment comprises a block for a modular foundation, with the block comprising a first surface, a second surface opposite the first surface, a plurality of side surfaces, and a plurality of elongated holes extending through the side surfaces. Each of the elongated holes extend in a direction different from the direction of said side surfaces.

In still another embodiment, a modular foundation system is provided, comprising a plurality of hexagonal blocks, a plurality of elongated holes through each of the blocks and running in at least three different directions, and a plurality of cables running through the holes in the at least three directions. Each of the blocks is configured next to at least one other of the blocks such that the holes of adjacent blocks are aligned. The cables fix the blocks together via post-tensioning. The at least three directions the cables run in differ from the direction of any joint lines between adjacent blocks, such that there are no bendable points along the joints of any adjacent blocks.

In yet another embodiment, a method for making a modular foundation system is provided, comprising arranging a plurality of pre-fabricated, hexagonal blocks in a desired configuration such that elongated holes disposed in each of the blocks are aligned with holes in adjacent blocks. Furthermore, cables or rods are passed through the elongated holes, with the cables or rods and their respective holes running in at least three different directions. The directions differ from the direction of any joint lines disposed between adjacent blocks. The cables or rods are then post-tensioned such that said blocks are tightly secured to each other.

These and other further features and advantages of the invention will be apparent to those skilled in the art from the following detailed description, taken together with the accompanying drawings, in which:

BRIEF DESCRIPTION OF THE DRAWINGS

FIG. 1 is a top plan view of one embodiment of a modular block according to the present invention;

FIG. 2 is a top perspective view of the modular block shown in FIG. 1;

FIG. 3 is a side perspective view of the modular block shown in FIG. 1;

FIG. 4 is another side perspective view of the modular block shown in FIG. 1;

FIG. 8 is a top plan view of one embodiment of a modular foundation system according to the present invention;

DETAILED DESCRIPTION OF THE INVENTION

Figure 5:
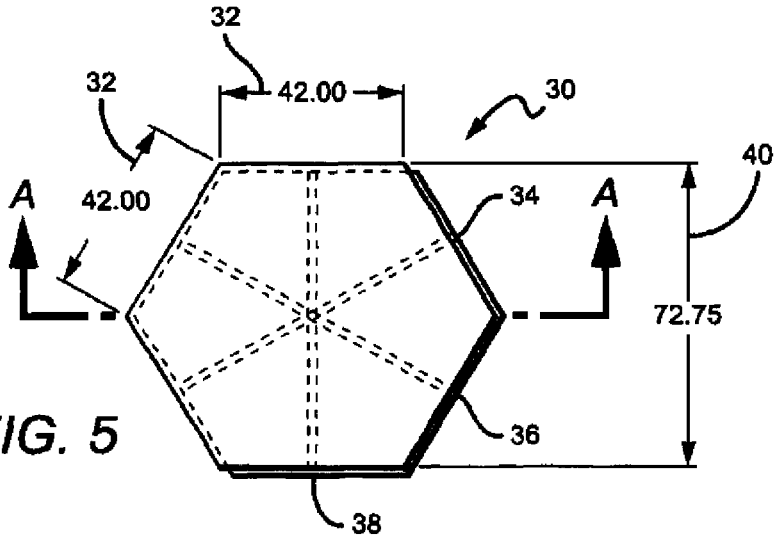
FIG. 5 is a sectional view with dimensions of one embodiment of a modular block according to the present invention.

The present invention is described herein with reference to certain embodiments, but it is understood that the invention can be embodied in many different forms and should not be construed as limited to the embodiments set forth herein.

Although the terms first, second, etc. may be used herein to describe various elements, components, regions, and/or sections, these elements, components, regions, and/or sections should not be limited by these terms. These terms are only used to distinguish one element, component, region, or section from another element, component, region, or section. Thus, a first element, component, region, or section discussed below could be termed a second element, component, regions, or section without departing from the teachings of the present invention.

FIGS. 1-4 show one embodiment of a modular block 10 constructed in accordance with the present invention, having: a first surface 12; a second surface 13 opposite the first surface 12; a middle section 14; a first cable hole 16; a second cable hole 18; a third cable hole 20; a first section 22; and, a second 24, with middle section 14 between first and second sections 22, 24. The modular block 10 and its components are preferably formed from a durable and castable construction material such as concrete or plaster, but can be formed from a number of different materials. Modular block 10 is generally hexagonal, and as such comprises six side surfaces. While modular block 10 is preferably hexagonal, it is understood that other shapes allowing side-by-side placement of multiple blocks with no bendable joints between/among blocks (as described in more detail below) are also contemplated in accordance with the present invention.

The first surface 12 of the modular block 10 is preferably substantially flat, with second surface 13 opposite the surface 12 and also preferably comprising a substantially flat surface. Middle section 14 is preferably equidistant between first surface 12 and second surface 13. Middle section 14 is between first and second sections 22, 24, and may also be slightly askew of the central longitudinal axis of first and second sections 22, 24. As such, three of middle section's six sides extend past three of the first and second sections' six sides, and three of middle section's six sides are indented in relation to three of the first and second sections' six sides. As will be described in more detail below, this arrangement of middle section 14 allows for two or more modular blocks 10 to be configured side-by-side, with the extended portion of one block's middle section 14 fitting into the indented portion of another block's middle section 14. Middle section 14 is preferably cast concurrently with first and second sections 22, 24 from the same mold; as such, the sections 14, 22, 24 all comprise a singular block unit. Alternatively, sections 14, 22, 24 may all be cast separately and later connected to each other using methods commonly known in the art.

Middle section 14 also comprises first cable hole 16, second cable hole 18, and third cable hole 20. Each of cable holes 16, 18, 20 are elongated and extend from one of the middle section's six sides all the way through the modular block 10 to an opposite side surface. The elongated holes 16, 18, 20 preferably follow a straight path parallel to the horizontal plane of middle layer 14. Holes 16, 18, 20 also each preferably follow paths along varying depths of middle section 14, such that cable hole 16 is at the shallowest depth, cable hole 18 is approximately midway through layer 14, and cable hole 20 is at the lowest depth. Reinforcement layers 19 may be added between each of the stacked holes. The holes 16, 18, 20 in each of modular blocks 10 are standardized such that they are in identical positions. As such, when two or more modular blocks are later configured side-by-side, the holes 16, 18, 20 of one block 10 align with the holes 16, 18, 20 of an adjacent block 10. While three holes are depicted in this example, it is understood that one or more holes may be included through each face of block(s) 10.

When two or more modular blocks 10 are configured side-by-side such that holes 16, 18, 20 of adjacent blocks 10 are aligned, the blocks may be fixed firmly to one another by passing cables or bars through the holes 16, 18, 20. When more than one hole is included through each face of the block(s) 10, additional cables or bars will likewise be run through each hole. The number of holes and cables/bars required will depend on the size of the foundation system to be constructed, as well as the force needed to pull the blocks of a foundation system together.

To securely connect adjacent blocks 10, post-tensioning techniques as are well known in the art may be applied (e.g. the post-tensioning techniques and products offered by VSL at www.vsl.net). For example, cables may be passed through the holes discussed above, tensioned, and then secured/anchored to the outside of the foundation system using anchoring devices such as wedges that are mounted to the end of the cables in the field using automatic, hand or other mechanical tools. Rods may also be used, which are threaded on the ends and secured with nuts and bolts.

At least one advantage of the post-tensioning techniques in conjunction with the cable holes and hexagonal blocks of the present invention is the ability for cables to run in directions different from any of the joint lines between adjacent blocks. One of the cable holes will always be perpendicular to one joint position, while the other two cable holes will be at an angle to the joint position (such as at a 30° angle). In this way, once post-tensioning is applied and adjacent blocks are secured to one another, there are no bendable points along the joints of adjacent blocks. Unlike prior art systems using square or rectangular blocks, the structure of the present invention results in a much stronger foundation; there are no continuous straight joints to act as hinge points.

At least one other advantage of the present invention is that the hexagonal shape of the individual blocks 10, along with the elongated holes 16, 18, 20, allows for post-tensioning of multiple, connected blocks to occur in three different directions. As such, no matter which direction the loading is from, there are always at least two post-tension cables or bars running in a different direction so as to better secure individual blocks to one another.

Figure 6:
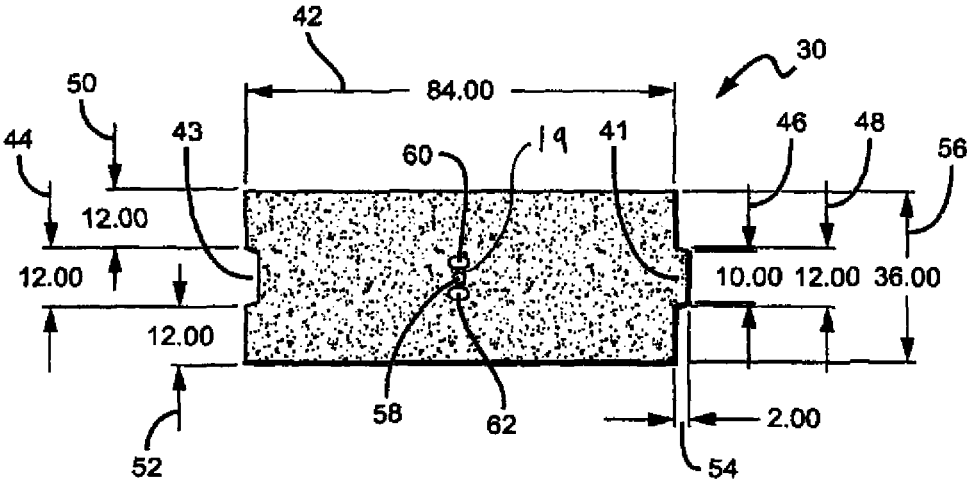
FIG. 6 is a sectional view with dimensions of section A of the modular block as shown in FIG. 5.

FIGS. 5 and 6 show modular block 30 with dimensions according to one possible embodiment of the present invention. As shown in FIG. 5, a preferred length 32 for each of the six sides of the hexagonal block 30 is approximately 42.00 inches, while a preferred distance 40 between two opposite sides is approximately 72.75 inches. Elongated cable holes 34, 36, 38 are shown via hidden lines, and are similar to holes 16, 18, as described in detail above.

FIG. 6 is a side view taken along section-line A of FIG. 5. As shown, a preferred distance 42 between one point of the hexagon to the opposite point is approximately 84.00 inches. The height 48 of the inner tapered portion of the extension 41 (similar to the extended portion of middle section 14) is approximately 12.00 inches, while the height 46 of the outer portion of the tapered extension is approximately 10.00 inches. The height 44 of the indented portion 43 (similar to the indented portion of middle section 14) is approximately 12.00 inches. The heights 50, 52 of the portions above and below extension 41 and indented portion 43 are each approximately 12.00, thus making the overall height 56 of the block 30 approximately 36.00 inches. The extension 41 may stick out a distance 54 that is approximately 2.00 inches from block 30 to correspond with a similar depth of indented portion 43. The dimensions of FIGS. 5 and 6 are meant to illustrate one possible embodiment of a modular block according to the present invention; however, the dimensions are not intended to limit the scope of the invention and it is understood that other dimensions are appropriate for and contemplated by the present invention.

FIG. 6 further depicts holes 58, 60, and 62, which are the cross-sectional views of elongated cable holes 34, 36, 38 described above. Hole 58 is shown from head-on, and represents the cross-section view of elongated hole 38, which runs perpendicular to the two sides of the hexagon it runs through. Hole 60 is an angular cross-section view of elongated hole 34, which runs at an approximate 30° angle with respect to the sides hole 38 runs through. Hole 62 is an angular cross-section view of elongated hole 36, which also runs at an approximate 30° angle with respect to the sides hole 38 runs through.

Figure 7:
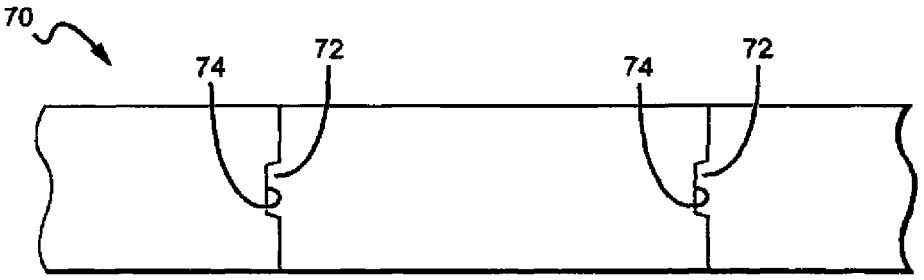
FIG. 7 is a schematic view of one possible embodiment for connecting two or more modular blocks according to the present invention.

FIG. 7 is a schematic view showing one possible embodiment 70 for closely fitting adjacent blocks to one another. As mentioned with respect to FIGS. 1-4, modular blocks according to the present invention may comprise a middle section 14 with portions extending from the greater block 10 and portions indented into the greater block 10. When two or more blocks 10 are configured side-by-side, the extended portions of one block will fit into the indented portions of an adjacent block. As more easily shown in FIG. 7, an extension 72 may be closely fitted within an indentation 74 of an adjacent block. Once the blocks are fitted together, the holes (as described above) will align and post-tensioning techniques can be applied to further secure the individual blocks to one another to create a unified foundation system. Although FIG. 7 depicts an extension/indentation connection means, it is understood that other suitable connection means may also be used. For example, the various sides of the hexagon blocks may comprise groove/tongue, male/female indentations, various interlocking means, and so forth.

Figure 8A:
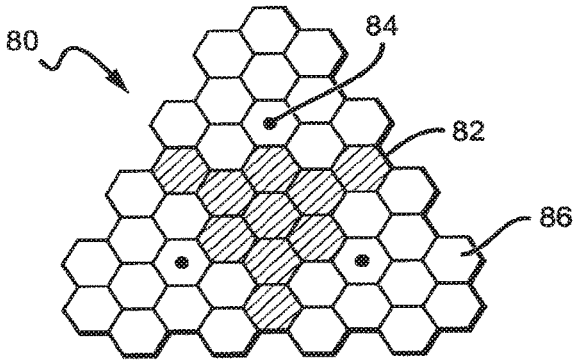
FIG. 8A is a top plan view of another embodiment of a modular foundation system according to the present invention.

FIGS. 8A-11 show various embodiments for modular foundation system configurations. In FIG. 8A, a generally triangular foundation configuration 80 is depicted, with the overall configuration consisting of 43 blocks. In the center portion of the configuration 80, darker shaded blocks 82 represent spaces where modular blocks may be at least twice as thick as surrounding blocks, such that the height of these blocks is approximately twice that (or greater) of a normal block. Such blocks may be provided by either casting thicker blocks (as shown in FIG. 8B), or by stacking at least two or more blocks (as shown in FIG. 8C). If stacked blocks are used, they may be secured to one another using any of a variety of means well known in the art. Such thicker block portions represent areas where greater strength and stability can be achieved.

The blocks 84 represented by the dots are the blocks the structure and/or apparatus will be directly attached to onsite. In this particular embodiment, the structure and/or apparatus would comprise a substantially triangular base. The blocks 84 may comprise integrated steel plates, which allow for anchor/bolt holes to be drilled into the blocks 84 onsite such that they will match the configuration of the structure and/or apparatus' anchor/bolt holes. When blocks 84 are cast, they may be cast such that a steel plate assembly is cast into the block. Alternatively, a steel plate assembly may be integrated with the block 84 post-casting and on location.

Blocks 86 represent regular modular blocks as depicted in FIGS. 1-6. Once blocks 82, 84, 86 are all fitted into place within the configuration, they may be securely attached to one another using post-tensioning or other suitable techniques; at this point they can act as a single foundation unit. All of blocks 82, 84, 86 may be cast from the same mold, although blocks 84 may be cast with the incorporation of a steel plate assembly. Even if blocks 82, 84, 86 are tightly secured to one another via post tensioning, they can be easily reconfigured at a later time should the needs for the foundation system change.

Figure 9:
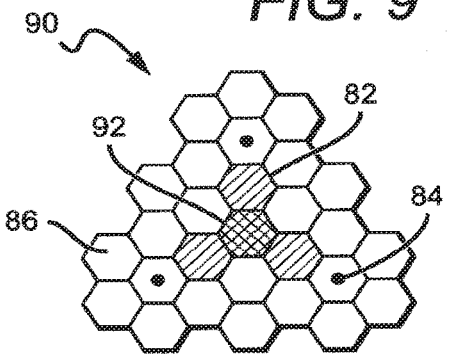
FIG. 9 is a top plan view of another embodiment of a modular foundation system according to the present invention.

FIG. 9 depicts another generally triangular foundation configuration 90, with the overall configuration consisting of 28 blocks. Since the FIG. 9 configuration consists of fewer blocks, it may be used to support a structure or apparatus that is smaller than that supported by foundation configuration 80. Alternatively, it may be used in a location where a smaller foundation system must be used.

As in configuration 80, the darker shaded blocks 82 represent spaces where thicker modular blocks may be used. The cross-hatched block 92 represents where a modular block approximately three times the thickness of a typical block may be placed. The blocks 82 and 92 represent areas where greater strength and stability can be achieved.

Figure 8B:
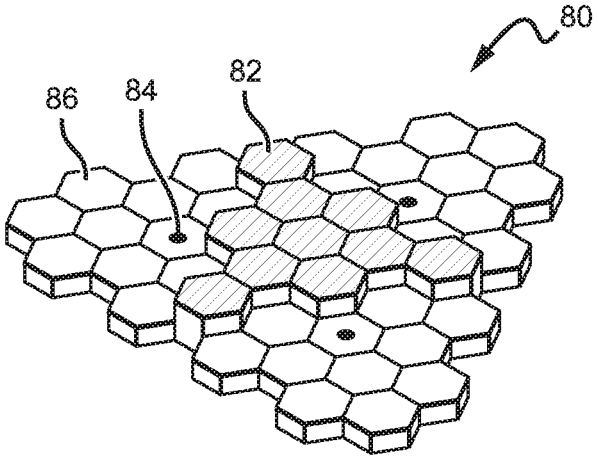
FIG. 8B is a side perspective view of another embodiment of a modular foundation system according to the present invention.
Figure 8C:
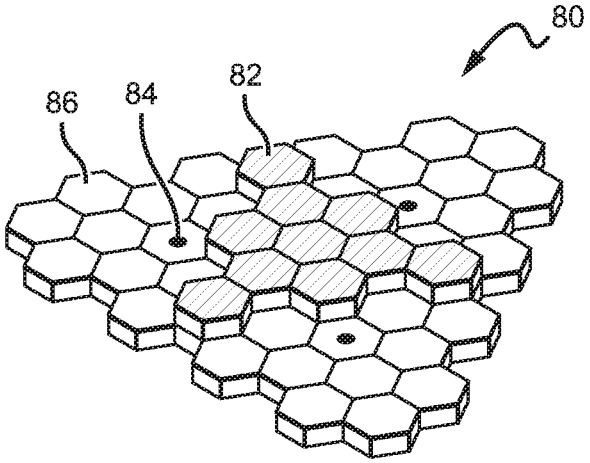
FIG. 8C is a side perspective view of another embodiment of a modular foundation system according to the present invention.

As in FIG. 8A-8C, the blocks 84 represented by the dots are the blocks the structure and/or apparatus will be directly attached to onsite. The blocks 86 represent regular modular blocks as depicted in FIGS. 1-6.

Figure 10:
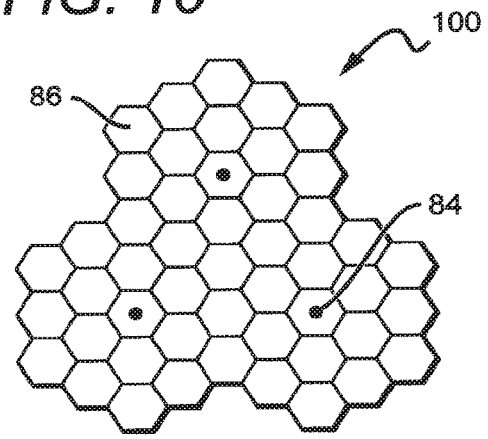
FIG. 10 is a top plan view of another embodiment of a modular foundation system according to the present invention.

FIG. 10 depicts another generally triangular foundation configuration 100, with the overall configuration consisting of 49 blocks. Since the FIG. 10 configuration consists of more blocks than that of the configurations of FIGS. 8A-9, it may be used to support a structure or apparatus that is larger than that supported by foundation configurations 80 and 90. As in configurations 80 and 90, the blocks 84 represented by the dots are the blocks the structure and/or apparatus will be directly attached to onsite. The blocks 86 represent regular modular blocks as depicted in FIGS. 1-6.

Figure 11:
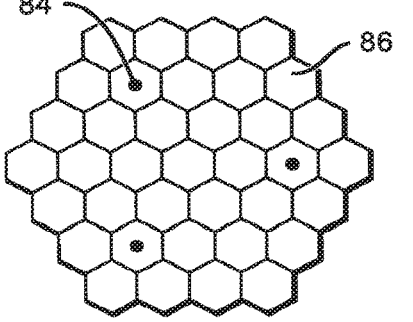
FIG. 11 is a top plan view of another embodiment of a modular foundation system according to the present invention.

FIG. 11 depicts a generally hexagonal foundation configuration 110, with the overall configuration consisting of 37 blocks and designed to support a structure and/or apparatus with a triangular base. As in configurations 80, 90, and 100, the blocks 84 are the blocks the structure and/or apparatus will be directly attached to onsite. The blocks 86 represent regular modular blocks.

Although FIGS. 8A-11 show several possible configurations for foundation systems, it is understood that other configurations are possible. For example, the hexagonal blocks may also be configured to create foundations with generally rectangular, square, oval, circular, diamond, etc. shaped configurations. Moreover, it is understood that foundation systems according to the present invention may support structures and/or apparatuses with bases other than just triangular. By way of example and not limitation, bases that are square, rectangular, diamond-shaped, and so forth may also be supported.

Figure 12:
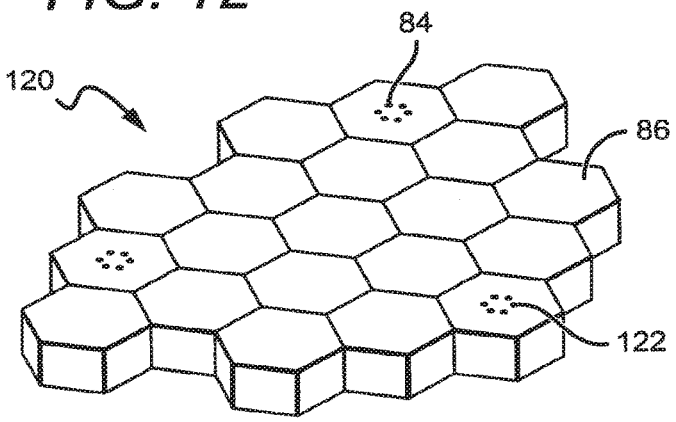
FIG. 12 is a perspective view of one embodiment of a modular foundation system according to the present invention.

FIG. 12 is a perspective view of a foundation system 120 according to the present invention. Foundation system 120 is generally triangular shaped, and shows block-types 84 and 86 as described above. Blocks 84 are shown with holes 122, with holes 122 representing where bolts and or other suitable connection means may be used to secure the base of a structure and/or apparatus with the foundation system. The holes 122 may be drilled into steel plate assemblies as described above such that the structure/apparatus base and the foundation system will receive a customized, onsite fit.

Figure 13:
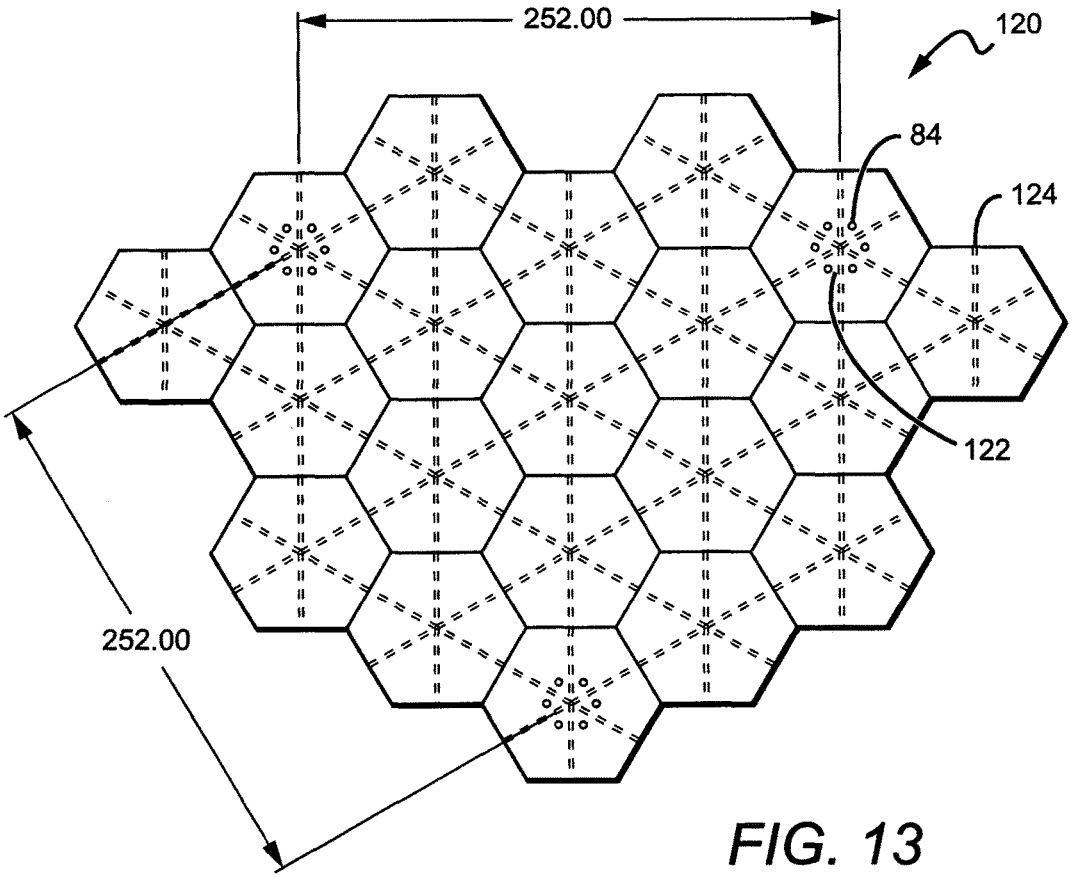
FIG. 13 is a top view of one embodiment of a modular foundation system showing hidden post tensioning lines according to the present invention.

FIG. 13 is a top view of foundation system 120, with hidden lines 124 shown to illustrate the elongated holes described in FIGS. 1-6. As shown in FIG. 13, the elongated holes of each individual modular block align with those of adjacent blocks. As such, cables, bars, rods, or the like may be easily threaded through the adjoining holes to connect adjacent blocks and secure them using post-tensioning technology. As depicted, the cables or bars run in three different directions, thus drawing all of the blocks toward the center of the foundation system and creating a stronger unit compared to those of the prior art.

In practice, the modular blocks would be pre-fabricated, with the size and number of blocks varying according to the structure and/or apparatus they will stabilize and secure. The pre-fabricated blocks will then be transported to a desired location, where they will be fitted together into a desired configuration. Cable or rods will be passed through the various holes in the middle layer of each block, and post-tensioning techniques will be employed to tightly secure individual blocks to one another such that they act together as a single foundation unit. The anchor holes of the structure and/or apparatus can then be assessed such that corresponding bolt holes may be drilled into steel plate assemblies onsite. The structure and/or apparatus can then be securely bolted down to the foundation system.

Although the present invention has been described in considerable detail with reference to certain preferred configurations and methods, other versions are possible. The modular blocks can be used in many different types of stabilizing applications. Different block shapes, dimensions, configurations, tensioning techniques, and side-by-side connection techniques can be used in conjunction with the new modular system and method. A variable number of modular blocks can be used to provide for any configuration and/or number of stabilizing footings utilizing the modular systems and methods contemplated by the present invention. Therefore, the spirit and scope of the above description should not be limited to the versions described above.

I claim:

1. A modular foundation system, comprising:

a plurality of hexagonal blocks;

at least three elongated holes through each of said blocks and running in at least three different directions, each of said blocks configured next to at least one other of said blocks such that the holes of adjacent blocks are aligned;

a plurality of cables running through said aligned holes in said at least three directions, said cables fixing said blocks together;

a connection means in at least three of said blocks; and a center block between said at least three blocks;

wherein the at least three directions said cables run in differ from the direction of any joint lines between adjacent blocks;

wherein said connection means are configured to secure a structure having a substantially triangular base to said foundation system; and wherein said center block is thicker than each of said at least three blocks.

2. The modular foundation system of claim 1, wherein said first surface has holes extending through to said second surface opposite said first surface, wherein said connection means comprises bolts.

3. The modular foundation system of claim 2, wherein said first surface holes are drilled into steel plate assemblies such that said structure base and said foundation system may receive a customized, onsite fit.

4. The modular foundation system of claim 1, wherein said base has corners located approximately at the center of said three blocks.

5. The modular foundation system of claim 1, wherein at least one of said hexagonal blocks is stacked on another of said hexagonal blocks.

6. The modular foundation system of claim 1, wherein the corners of said substantially triangular base are substantially equidistant from one another.

7. A modular foundation system, comprising:

a plurality of hexagonal blocks;

at least three elongated holes through each of said blocks and running in at least three different directions, each of said blocks configured next to at least one other of said blocks such that the holes of adjacent blocks are aligned;

a plurality of cables running through said aligned holes in said at least three directions, said cables fixing said blocks together; and a connection means in at least three of said blocks;

wherein the at least three directions said cables run in differ from the direction of any joint lines between adjacent blocks; and wherein said connection means are configured to secure a structure having a substantially triangular base to said foundation system; and wherein at least one of said hexagonal blocks is stacked on another of said hexagonal blocks.

8. The modular foundation system of claim 7, wherein said first surface has holes extending through to said second surface opposite said first surface, wherein said connection means comprises bolts.

9. The modular foundation system of claim 8, wherein said first surface holes are drilled into steel plate assemblies such that said structure base and said foundation system may receive a customized, onsite fit.

10. The modular foundation system of claim 7, wherein said base has corners located approximately at the center of said three blocks.

11. The modular foundation system of claim 7, wherein the corners of said substantially triangular base are substantially equidistant from one another.

* * * * *